US008758030B2

(12) United States Patent
Chen

(10) Patent No.: US 8,758,030 B2
(45) Date of Patent: Jun. 24, 2014

(54) FLEXIBLE CABLE CONNECTOR ASSEMBLY

(71) Applicant: Bing Xu Precision Co. Ltd., Taipei (TW)

(72) Inventor: Chih-Jung Chen, Taipei (TW)

(73) Assignee: Bing Xu Precision Co. Ltd., Taipei (TW)

( * ) Notice: Subject to any disclaimer, the term of this patent is extended or adjusted under 35 U.S.C. 154(b) by 42 days.

(21) Appl. No.: 13/749,959

(22) Filed: Jan. 25, 2013

(65) Prior Publication Data

US 2014/0004736 A1 Jan. 2, 2014

(30) Foreign Application Priority Data

Jun. 29, 2012 (TW) ..... 101212551 U

(51) Int. Cl.
*H01R 12/00* (2006.01)

(52) U.S. Cl.
USPC ..... 439/76.1; 439/493

(58) Field of Classification Search
USPC ..... 439/76.1, 492, 493, 499
See application file for complete search history.

(56) References Cited

U.S. PATENT DOCUMENTS 6,695,641 B1 * 2/2004 Lee ..... 439/493
6,773,286 B1 * 8/2004 Wu ..... 439/247
6,824,426 B1 * 11/2004 Spink, Jr. ..... 439/579
6,832,931 B1 * 12/2004 Wu ..... 439/499
6,896,556 B1 * 5/2005 Wu ..... 439/638
6,976,869 B1 * 12/2005 Wu ..... 439/499
7,452,238 B1 * 11/2008 Wu ..... 439/579
7,465,189 B2 * 12/2008 Marcade et al. ..... 439/567
7,467,953 B2 * 12/2008 Kuo et al. ..... 439/67
7,484,994 B2 * 2/2009 Ko ..... 439/495
7,553,191 B2 * 6/2009 Su et al. ..... 439/637
7,559,796 B1 * 7/2009 Wu ..... 439/564
7,563,108 B1 * 7/2009 Wu ..... 439/76.1
7,572,144 B1 * 8/2009 Wu ..... 439/545
7,585,184 B2 * 9/2009 Su et al. ..... 439/579
7,607,930 B1 * 10/2009 Wu ..... 439/247
7,618,282 B2 * 11/2009 Wu et al. ..... 439/496
7,651,350 B1 * 1/2010 Wu ..... 439/153
7,682,162 B2 * 3/2010 Yuan ..... 439/76.1
7,708,587 B2 * 5/2010 Wu ..... 439/492
7,753,737 B2 * 7/2010 Yang et al. ..... 439/660
7,794,273 B2 * 9/2010 Xu et al. ..... 439/555
7,803,009 B2 * 9/2010 Su et al. ..... 439/492
7,815,459 B2 * 10/2010 Chen et al. ..... 439/351
7,922,527 B2 * 4/2011 Xu et al. ..... 439/557
7,938,668 B2 * 5/2011 Chen et al. ..... 439/351
8,007,324 B2 * 8/2011 Wang et al. ..... 439/660

(Continued)

FOREIGN PATENT DOCUMENTS

CN 201266719 7/2009
TW M348367 1/2009

*Primary Examiner* — Ross Gushi
(74) *Attorney, Agent, or Firm* — Lowe Hauptman & Ham, LLP

(57) ABSTRACT

Disclosed is a flexible cable connector assembly which comprises an insulative body, a PCB, a flexible cable and a protective film. The insulative body comprises at least a plurality of first terminals, the PCB is fixed at the rear-end of the insulative body, the protective film is adhered to the insulative layer of the flexible cable, and the flexible cable and the first terminals are electrically connected through the PCB; wherein a wire slot is defined by the PCB and the insulative body, whereby the protective film and the flexible cable are passed outwardly therethrough.

33 Claims, 18 Drawing Sheets

(56) References Cited

U.S. PATENT DOCUMENTS

| | | | | |
|---|---|---|---|---|
| 8,182,284 | B2 * | 5/2012 | Kuo | 439/545 |
| 8,202,127 | B2 * | 6/2012 | Zhang et al. | 439/660 |
| 8,342,886 | B2 * | 1/2013 | Zhang et al. | 439/660 |
| 8,512,071 | B2 * | 8/2013 | Tseng et al. | 439/493 |
| 8,523,608 | B2 * | 9/2013 | Fu | 439/545 |
| 8,672,689 | B2 * | 3/2014 | Tseng | 439/76.1 |
| 2005/0101184 | A1 * | 5/2005 | Chang et al. | 439/564 |
| 2005/0272303 | A1 * | 12/2005 | Wu | 439/499 |
| 2006/0079119 | A1 * | 4/2006 | Wu | 439/492 |
| 2006/0094267 | A1 * | 5/2006 | Li | 439/76.1 |
| 2006/0276083 | A1 * | 12/2006 | Sun | 439/638 |
| 2006/0286860 | A1 * | 12/2006 | Sun | 439/499 |
| 2007/0026715 | A1 * | 2/2007 | Huang et al. | 439/260 |
| 2007/0254496 | A1 * | 11/2007 | Koiwaya | 439/31 |
| 2008/0176442 | A1 * | 7/2008 | Kuo et al. | 439/494 |
| 2008/0188136 | A1 * | 8/2008 | Su et al. | 439/660 |
| 2008/0214054 | A1 * | 9/2008 | Su et al. | 439/637 |
| 2009/0068896 | A1 * | 3/2009 | Zhang | 439/626 |
| 2009/0130878 | A1 * | 5/2009 | Xu et al. | 439/157 |
| 2009/0215295 | A1 * | 8/2009 | Tseng | 439/247 |
| 2009/0275244 | A1 * | 11/2009 | Chen et al. | 439/676 |
| 2009/0301761 | A1 * | 12/2009 | Wu | 174/250 |
| 2010/0009569 | A1 * | 1/2010 | Su et al. | 439/552 |
| 2010/0035477 | A1 * | 2/2010 | Yuan | 439/638 |
| 2011/0076865 | A1 * | 3/2011 | Luo et al. | 439/82 |
| 2012/0009825 | A1 * | 1/2012 | Chen | 439/660 |
| 2012/0077389 | A1 * | 3/2012 | Zhang et al. | 439/660 |
| 2012/0100760 | A1 * | 4/2012 | Liu et al. | 439/660 |
| 2012/0108109 | A1 * | 5/2012 | Zhang et al. | 439/629 |
| 2012/0252260 | A1 * | 10/2012 | Tseng et al. | 439/499 |
| 2013/0109244 | A1 * | 5/2013 | Chen | 439/682 |
| 2013/0109245 | A1 * | 5/2013 | Tseng | 439/682 |
| 2013/0149895 | A1 * | 6/2013 | Fu | 439/545 |
| 2013/0217261 | A1 * | 8/2013 | Chen et al. | 439/499 |
| 2013/0303018 | A1 * | 11/2013 | Tseng et al. | 439/492 |
| 2014/0004736 | A1 * | 1/2014 | Chen | 439/493 |
| 2014/0113484 | A1 * | 4/2014 | Chen | 439/492 |

* cited by examiner

FLEXIBLE CABLE CONNECTOR ASSEMBLY

CROSS REFERENCE TO RELATED APPLICATION

This application claims the priority of Taiwanese Patent Application No. 101212551, filed on Jun. 29, 2012 in the TIPO (Intellectual Property Office), the disclosure of which is incorporated herein in their entirety by reference.

BACKGROUND OF THE PRESENT INVENTION

1. Field of the Invention

The present invention relates to a flexible cable connector assembly, and particularly relates to a connector assembly with a printed circuit board (PCB), whereby the PCB is electrically connected to a flexible cable, and the flexible cable is a flexible flat cable (FFC) or a flexible print circuit (FPC).

2. Description of the Prior Art

Conventional technologies, such as the Taiwan patent No. M348367 "A cable connector assembly" (and its related foreign patents are CN patent publication No. CN201266719 and U.S. Pat. No. 7,815,459), the cable connector comprises an insulative body, a plurality of conductive terminals housed in the insulative body, a separator plate separating the conductive terminals, a support which is fixed on the insulative body, a cable electrically connecting the conductive terminals, and a cap clapping on the insulative body. Amongst, the base of the cap and the bottom of the insulative body are jointed thereto. The base which is jointed and the cap are disposed on different sides of the bottom of the insulative body, and an accommodation space is defined, thereby the conductive terminals and the cable are electrically connected in the accommodation space.

However, a conventional cable connector assembly requires specialized cable management and processes for the cable to be welded to the conductive terminals, and the cable assembly process is complicated to be operated manually and difficult to be manufactured, and the cable management equipment and the processes are adding to the overall cost of manufacture, thus, improving the structure is necessary. Besides, the outgoing terminal of the cable is held by the cover and the insulative body, therefore, the outgoing terminal of the cable is easily bent and requires proper protection to prevent damage while the cable is bent.

BRIEF SUMMARY OF THE INVENTION

Accordingly, the main objective of the present invention is to provide a flexible cable connector assembly, and the flexible cable connector assembly comprises an insulative body, a PCB, a flexible cable and a protective film, the insulative body at least comprises a plurality of first terminals inserted into the insulative body, the PCB is fixed to the rear-end of the insulative body, the protective film is adhered to the insulative layer, and the flexible cable and the first terminals are electrically connected through the PCB; wherein a wire slot is defined by the PCB and the insulative body, whereby the protective film and the flexible cable are passed therethrough.

One object of the present invention has the benefit that a bending member is defined by the protective film and the front-end of the flexible cable, wherein the protective film provides proper protection for the bending member so as to avoid damage to the bending member while it is bent, and prevent abrasive wear between the flexible cable and the insulative body.

Another object of the present invention has the benefit that the protective film is a conductive shielding film containing high conductive materials, and when a plurality of conductors of the flexible cable are transmitting signals, the protective film provides proper shielding to eliminate the crosstalk among the conductors as well as reduces the electrical interference from the surrounding.

A first technical solution adopted by the present invention is a flexible cable connector assembly which comprises:

an insulative body having a plurality of first terminal slots and a plurality of slots;

a printed circuit board (PCB) having a plurality of first welding parts and a plurality of conductive parts, the PCB is fixed upright into an accommodation space at the rear-end of the insulative body;

a plurality of first terminals inserting into the slots of the insulative body, the first terminals having rear-ends being welded to the first welding parts of the PCB;

a flexible cable having an insulative layer, covering a plurality of conductors, and the conductors of the flexible cable are electrically connected to the conductive parts of the PCB; and a protective film adhered to the insulative layer of the flexible cable; wherein the insulative body comprises a first inserting space, and through the first terminal slots, the contacting parts of the first terminals are extended into the first inserting space, also a wire slot is defined by the insulative body and the PCB, whereby the flexible cable and the protective film are passed outwardly therethrough.

A second technical solution adopted by the present invention is a flexible cable connector assembly which comprises:

an insulative body having a plurality of first terminal slots, a plurality of second terminal slots and a plurality of slots;

a printed circuit board (PCB) having a plurality of first welding parts, a plurality of second welding parts and a plurality of conductive parts, the PCB is fixed upright into an accommodation space at the rear-end of the insulative body;

a plurality of first terminals inserting into the slots of the insulative body, the first terminals having rear-ends being welded to the first welding parts of the PCB;

a plurality of second terminals inserting into the slots of the insulative body, the second terminals having rear-ends being welded to the second welding parts of the PCB;

a flexible cable having an insulative layer, covering a plurality of conductors, and the conductors of the flexible cable are electrically connected to the conductive parts of the PCB;

a protective film adhered to the insulative layer of the flexible cable; and an insulative film adhered to the exterior side surface of the PCB, wherein the insulative body comprises a first inserting space and a second inserting space, through the first terminals slots, the contacting parts of the first terminals are extended into the first inserting space, and through the second terminals slots, the contacting parts of the second terminals are extended into the second inserting space, also a wire slot is defined by the insulative body and the PCB, whereby the flexible cable and the protective film are passed outwardly therethrough.

A third technical solution adopted by the present invention is a flexible cable connector assembly which comprises:

an insulative body having a plurality of first terminal slots, a plurality of second terminal slots and a plurality of slots;

a PCB having a plurality of first welding parts, a plurality of second welding parts and a plurality of conductive parts, the PCB is fixed upright into an accommodation space at the rear-end of the insulative body;

a plurality of first terminals inserting into the slots of the insulative body, the first terminals having rear-ends being welded to the first welding parts of the PCB;

a plurality of second terminals inserting into the slots of the insulative body, the second terminals having rear-ends being welded to the second welding parts of the PCB;

a flexible cable having an insulative layer, covering a plurality of conductors, and the conductors of the flexible cable are electrically connected to the conductive parts of the PCB;

a protective film adhered to the insulative layer of the flexible cable; and a cover clapping onto the rear-end of the insulative body; wherein the insulative body comprises a first inserting space and a second inserting space, through the first terminals slots, the contacting parts of the first terminals are extended into the first inserting space, and through the second terminals slots, the contacting parts of the second terminals are extended into the second inserting space, also a wire slot is defined by the insulative body and the PCB, whereby the flexible cable and the protective film are passed outwardly therethrough.

BRIEF DESCRIPTION OF THE DRAWINGS

The drawings are described as follows.

FIG. 10 is a front-view of a PCB in a third embodiment according to the present invention;

FIG. 11 is a rear-view of a PCB in a third embodiment according to the present invention;

FIG. 12 is a first dimensional diagram of a forth embodiment according to the present invention;

FIG. 13 is a second dimensional diagram of a forth embodiment according to the present invention;

FIG. 14 is a cross-sectional diagram of FIG. 12 along D-D;

FIG. 15 is a cross-sectional diagram of FIG. 13 along E-E;

FIG. 16 is a first exploded dimensional diagram of a forth embodiment according to the present invention;

FIG. 18 is a first dimensional diagram of a fifth embodiment according to the present invention;

FIG. 19 is a second dimensional diagram of a fifth embodiment according to the present invention;

FIG. 20 is a cross-sectional diagram of FIG. 18 along F-F;

FIG. 21 is a partial cross-sectional diagram of FIG. 19 along G-G;

FIG. 22 is a first dimensional diagram of a fifth embodiment according to the present invention;

FIG. 23 is a second dimensional diagram of a fifth embodiment according to the present invention;

FIG. 24 is a first dimensional diagram of a sixth embodiment according to the present invention;

FIG. 25 is a cross-sectional diagram of FIG. 24 along H-H;

FIG. 26 is a partial cross-sectional diagram of a seventh embodiment according to the present invention;

FIG. 27 is a partial cross-sectional diagram of an eighth embodiment according to the present invention;

FIG. 28 is a partial cross-sectional diagram of a ninth embodiment according to the present invention;

DETAILED DESCRIPTION OF THE PREFERRED EMBODIMENTS

Figure 1:
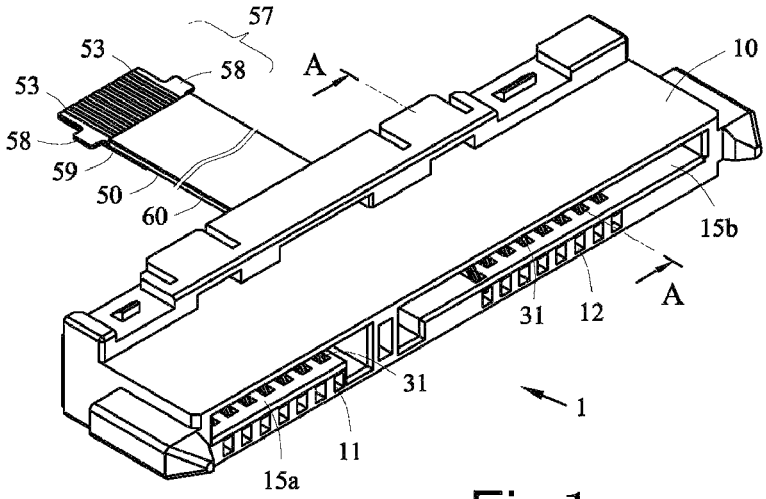
FIG. 1 is a first dimensional diagram of a preferred embodiment according to the present invention.
Figure 2:
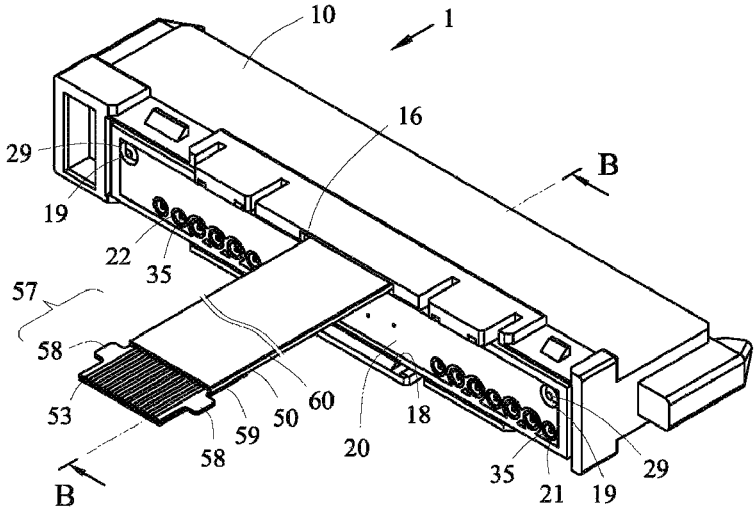
FIG. 2 is a second dimensional diagram of a preferred embodiment according to the present invention.
Figure 3:
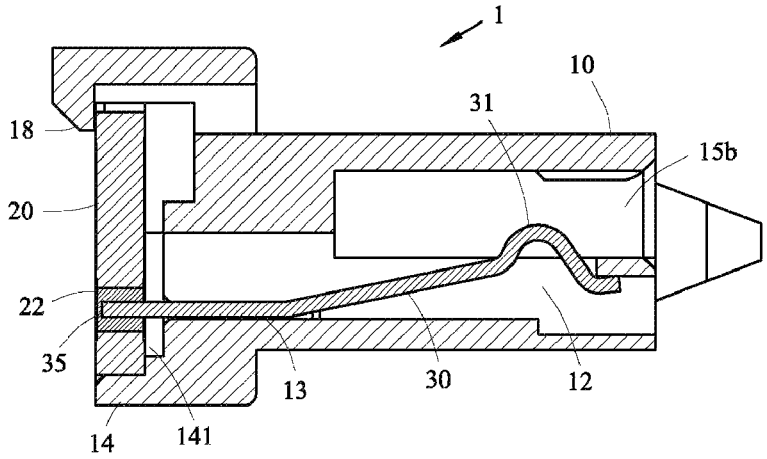
FIG. 3 is a cross-sectional diagram of FIG. 1 along A-A.
Figure 4:
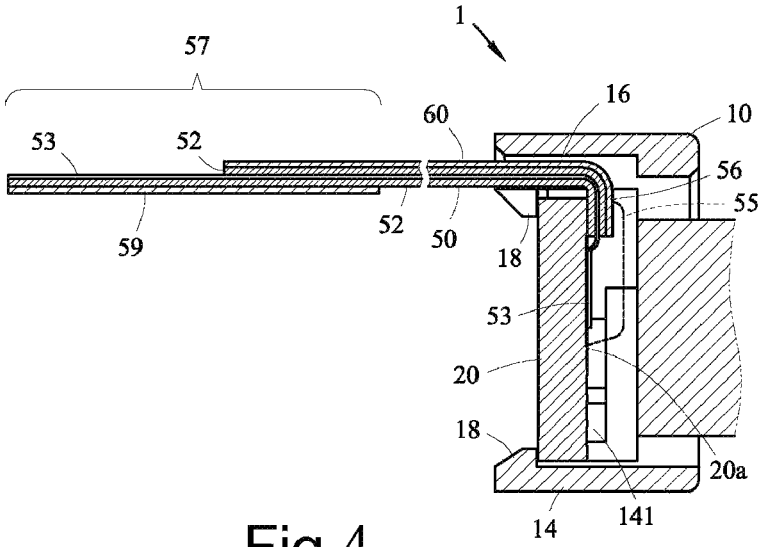
FIG. 4 is a cross-sectional diagram of FIG. 2 along B-B.
Figure 5:
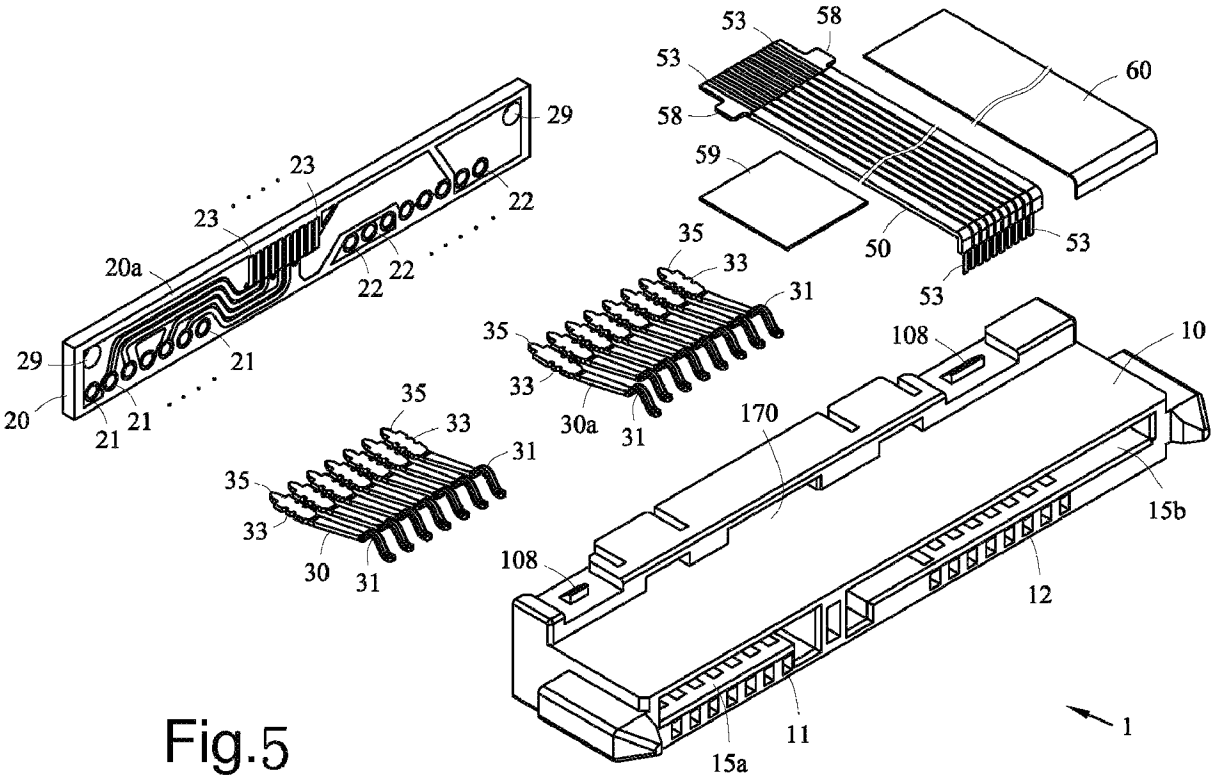
FIG. 5 is an first exploded dimensional diagram of a preferred embodiment according to the present invention.
Figure 6:
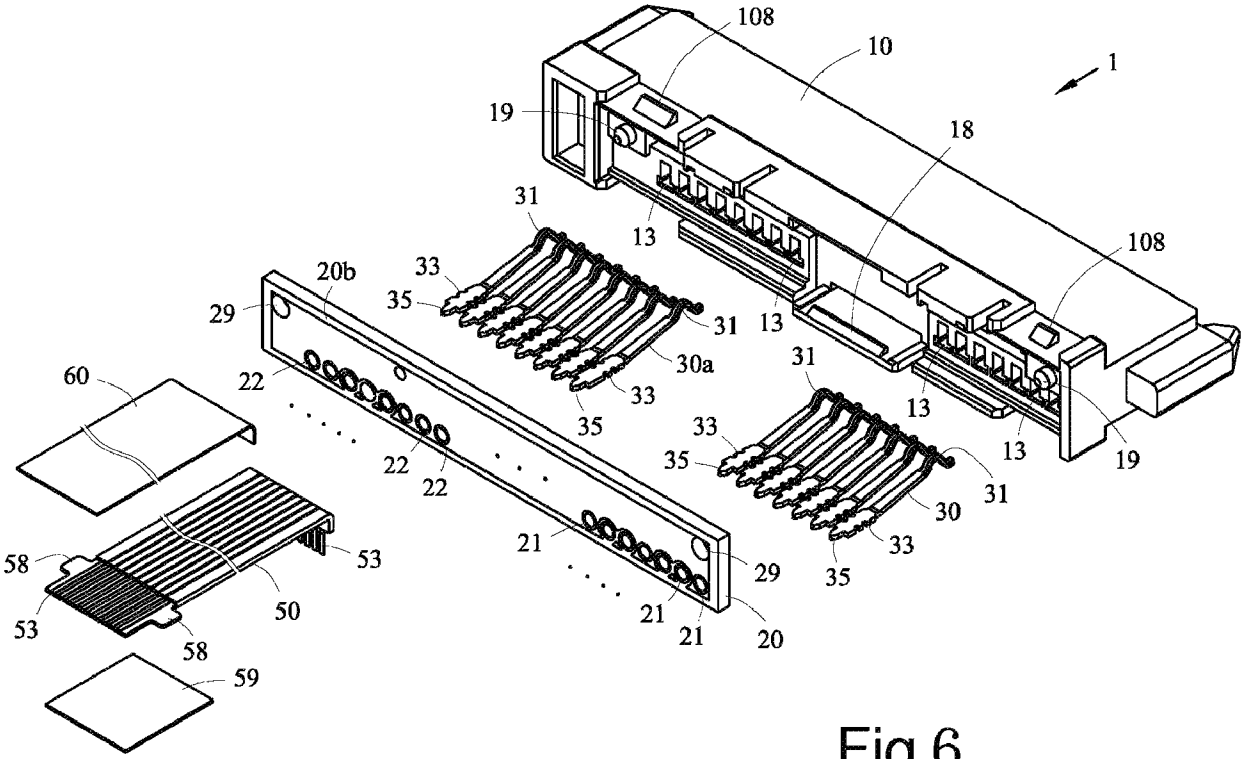
FIG. 6 is an second exploded dimensional diagram of a preferred embodiment according to the present invention.

To describe the technical matters, structural features, achieved objects and effects, embodiments are described in detail with reference to the accompanying drawings as follows.

Please refer to FIGS. 1 to 6, in a preferred embodiment according to the present invention, the flexible cable connector assembly 1 comprises: an insulative body 10, a printed circuit board 20, a plurality of first terminals 30, a plurality of second terminals 30*a*, a flexible cable 50 and a protective film 60; wherein the insulative body 10 comprises a plurality of first terminal slots 11, a plurality of second terminal slots 12 and a plurality of slots 13, the PCB 20 comprises a plurality of first welding parts 21, a plurality of second welding parts 22 and a plurality of conductive parts 23, the PCB 20 is fixed upright into an accommodation space 141 at the rear-end 14 of the insulative body; the first terminals 30 are inserted into the slots 13 (e.g. a hook 33 is inserted into the slots 13), the rear-ends 35 of the first terminals 30 are welded onto the welding parts 21 of the PCB 20; the second terminals 30 are inserted into the slots 13 (e.g. a hook 33 is inserted into the slots 13), the rear-ends 35 of the second terminals 30*a* are welded to the second welding parts 22 of the PCB 20; the flexible cable 50 is a flexible flat cable (FFC) or a flexible print circuit (FPC) and having an insulative layer 52 which is utilized to cover conductors 53 electrically connected to the conductive parts 23 of the PCB 20; the protective film 60 is a conductive shielding film containing high conductive materials, and the protective film 60 is adhered to the insulative layer 52 of the flexible cable 50; wherein the insulative body 10 comprises a first inserting space 15*a* and a second inserting space 15*b*, whereby the contacting parts 31 of the first terminals 30 are extended into the first inserting space 15*a* via the first terminals slots 11 and the contacting parts 31 of the second terminals 30*a* are extended into the second inserting space 15*b* via the second terminals slots 12, and a wire slot 16 is defined by the insulative body 10 and the PCB 20, whereby the flexible cable 50 and the protective film 60 are passed outwardly therethrough.

The exemplary protecting of the protective film 60 to the flexible cable 50 is described as follows: a bending member 56 is defined by the protective film 60 and the front-end of the flexible cable 50, the bending member 56 extends into the interior side surface 20*a* of the PCB 20 via a wire slot 16, the protective film 60 is suitable to provide the bending member 56 with proper protection so as to avoid damage to the bending member 56 while it is bent, in the meantime, the protective film 60 is suitable to provide the flexible cable 50 with proper protection to prevent the flexible cable 50 from abrasive wear between the flexible cable and the insulative body.

The exemplary shielding of the protective film 60 to the flexible cable 50 is described as follows: the protective film 60 is a conductive shielding film containing high conductive materials (e.g. a conductive shielding film which contains a copper foil or an aluminum foil), when the conductors 53 of the flexible cable 50 is transmitting signals, proper shielding is provided by the protective film 60 to eliminate the crosstalk among the conductors 53 and to reduce the electrical interferences from the surrounding.

The exemplary protecting of the flexible cable 50 and the PCB 20 is as follows: a bending member 56 is defined by the protective film 60 and the front-end of the flexible cable 50, a gel is coated onto the bending member 56 and the conductive parts 23 of the PCB 20.

The exemplary fixing of the insulative body 10 and the PCB 20 is described as follows: the insulative body 10 comprises a pair of hooks 18 and a pair of positioning rods 19, and the insulative body 10 engages the PCB 20 using the two hooks 18, and the PCB 20 is fixed upright into the accommodation space 141 at the rear-end 14 of the insulative body with a pair of fixing holes of the PCB 20 being passed therethrough by the two positioning rods 19.

Figure 7:
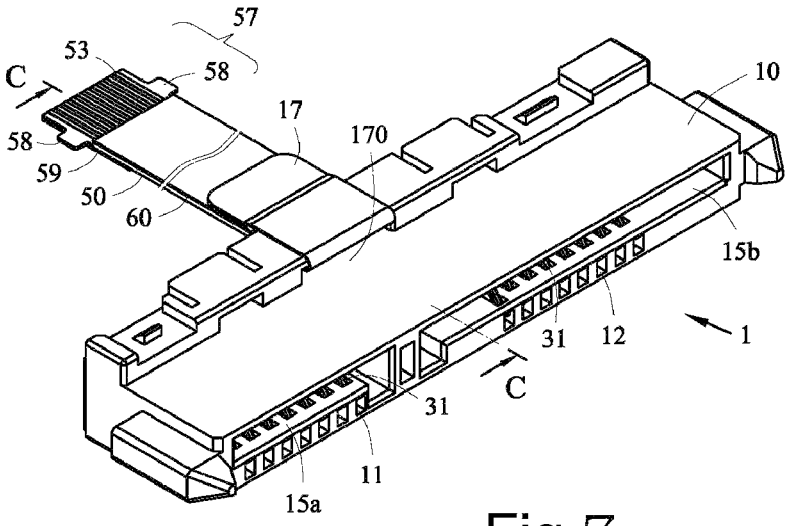
FIG. 7 is a dimensional diagram of a second embodiment according to the present invention.
Figure 8:
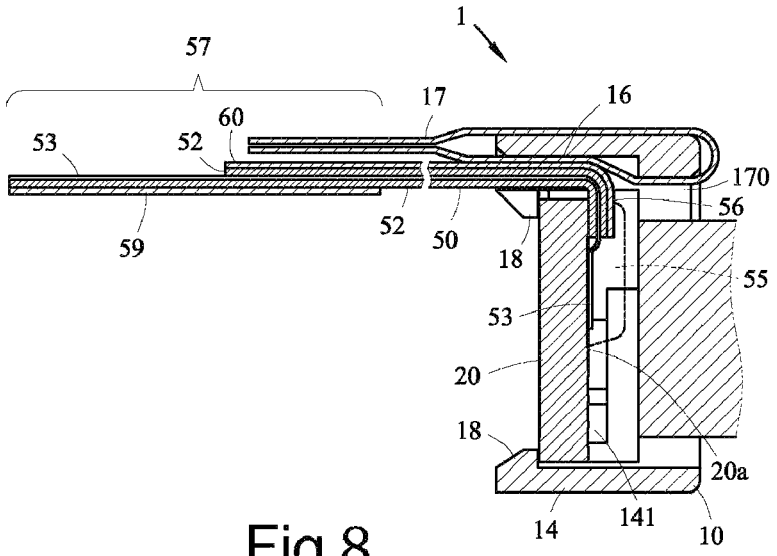
FIG. 8 is a cross-sectional diagram of FIG. 7 along C-C.
Figure 9:
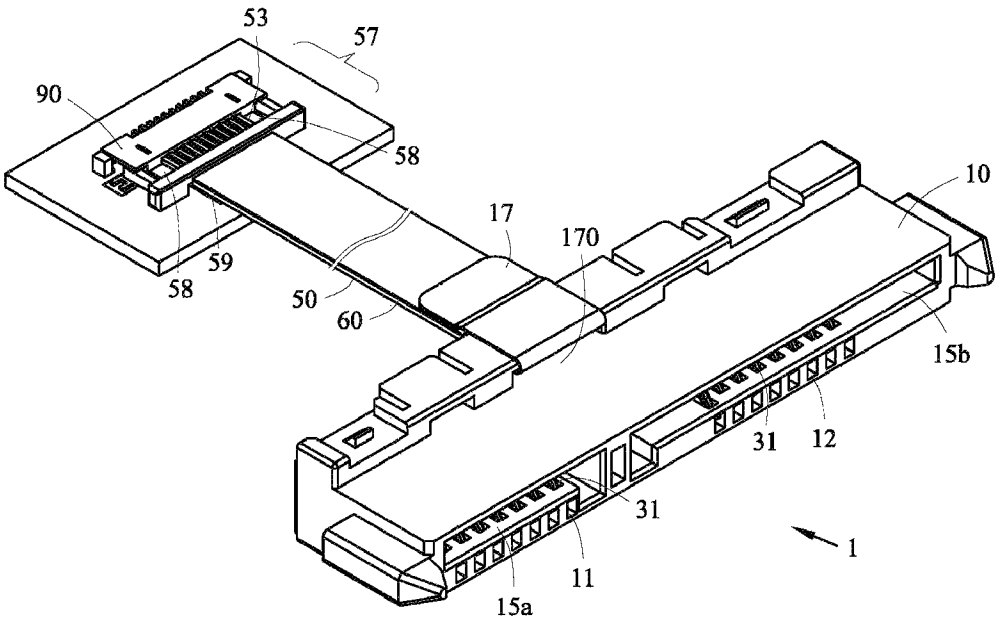
FIG. 9 is an diagram of an assembled status in a preferred embodiment according to the present invention.
Figure 1:
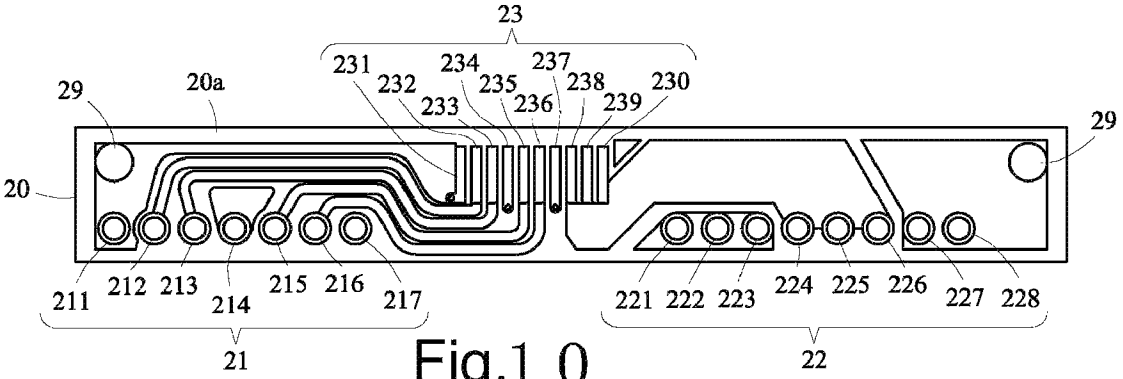
Figure 1:
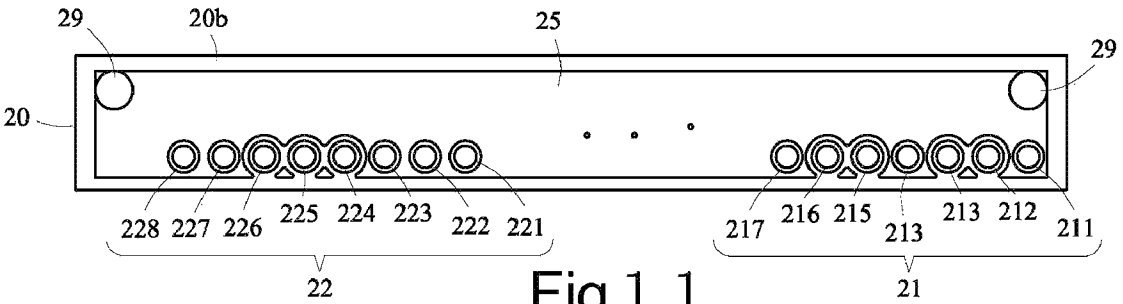
Figure 1:
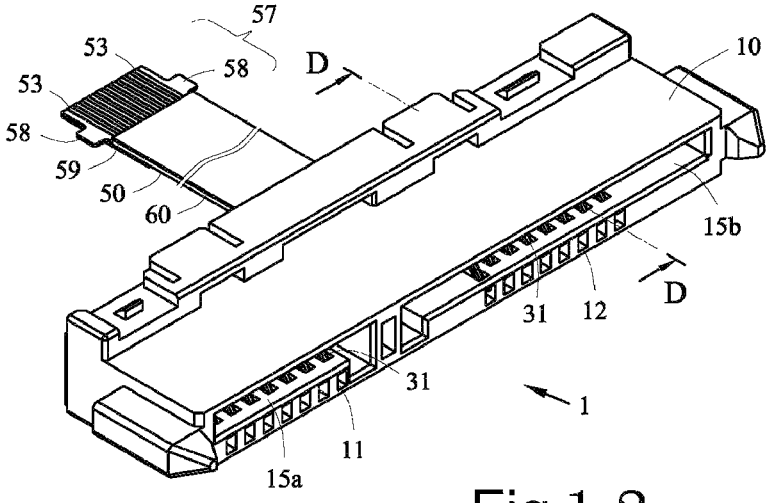
Figure 1:
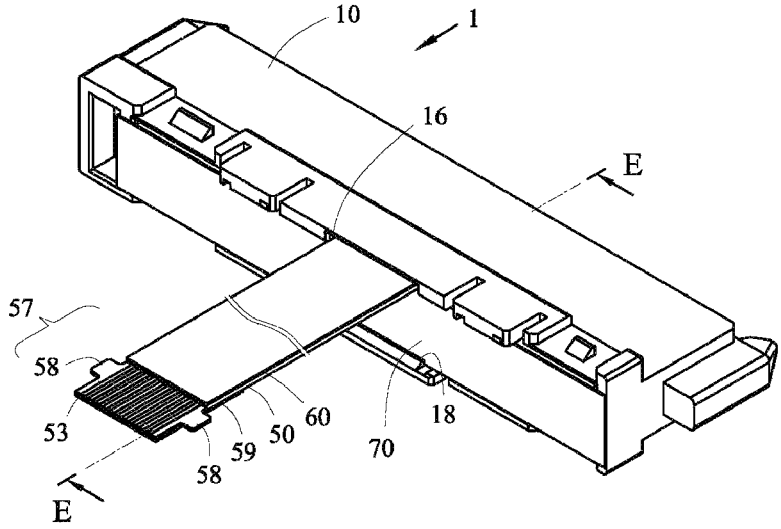
Figure 1:
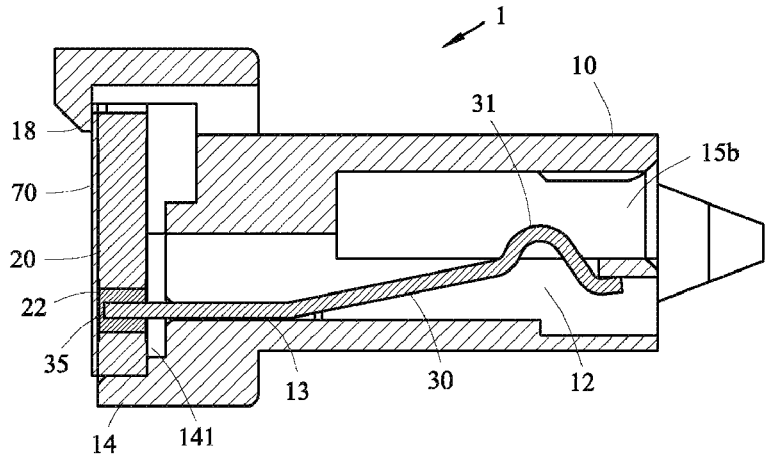
Figure 1:
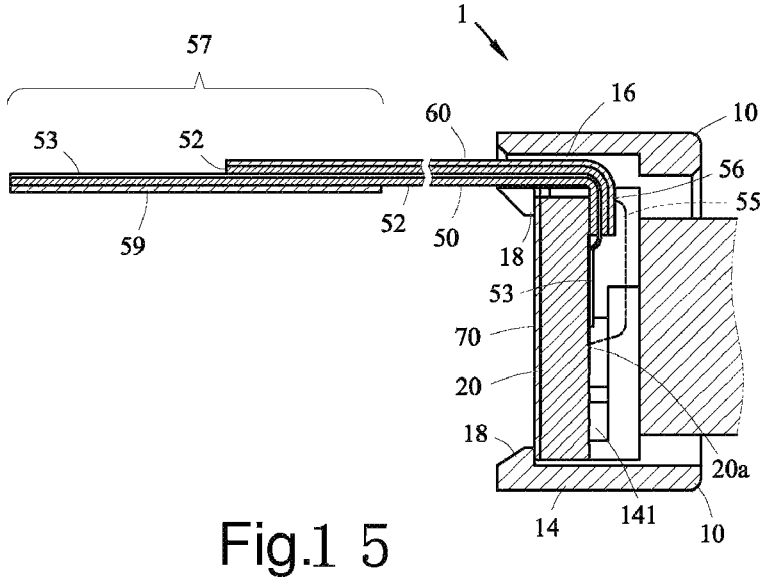
Figure 1:
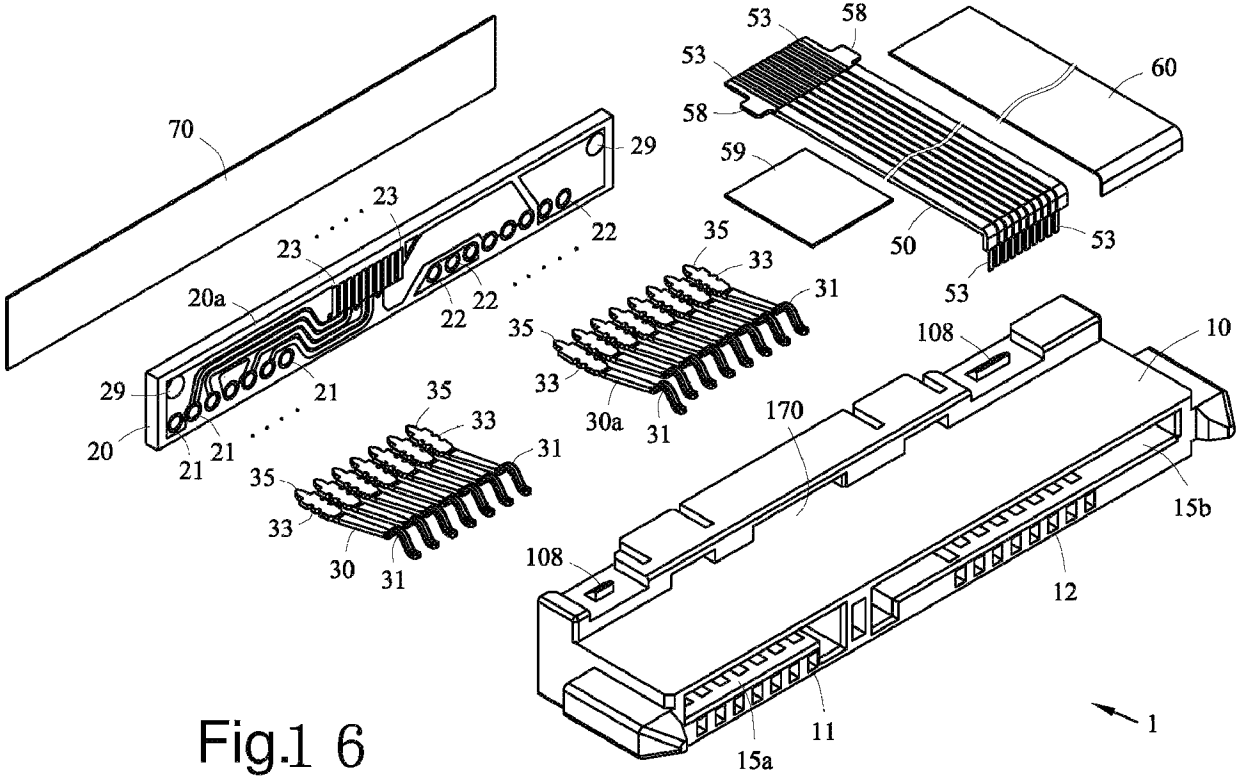
Figure 17:
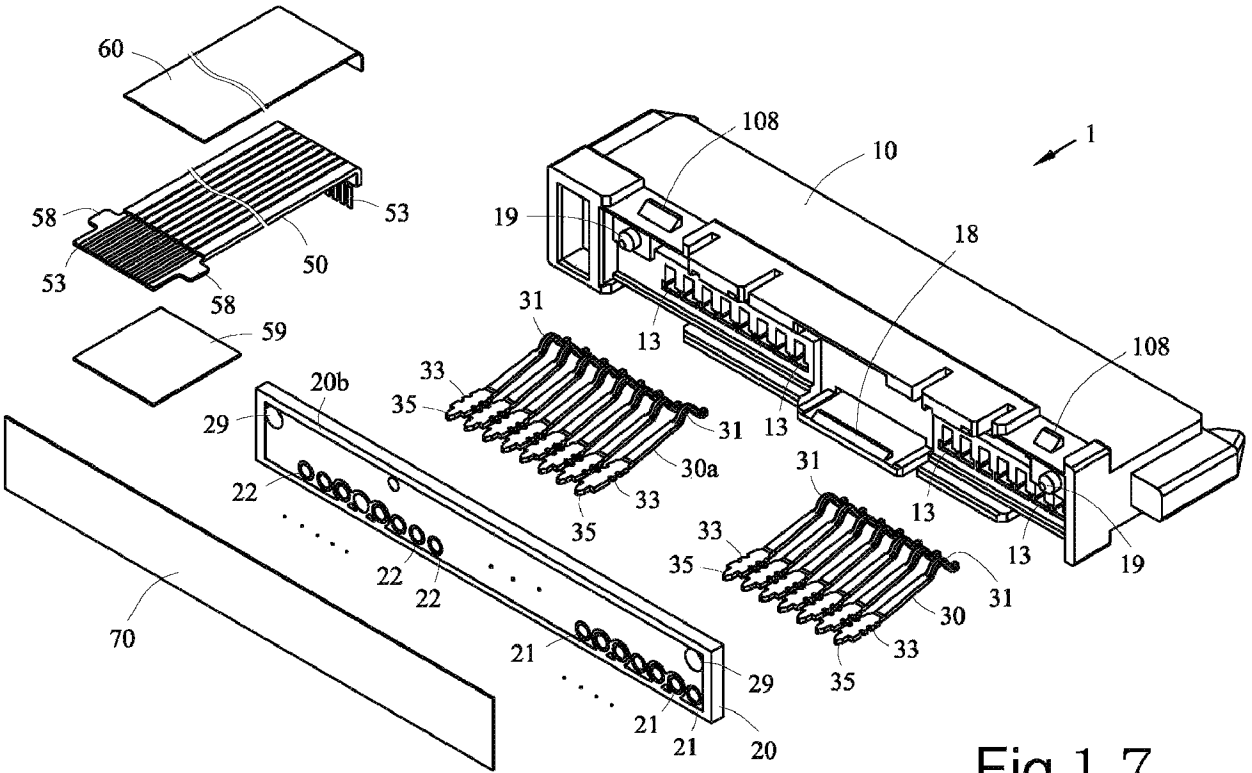
FIG. 17 is a second exploded dimensional diagram of a forth embodiment according to the present invention.
Figure 1:
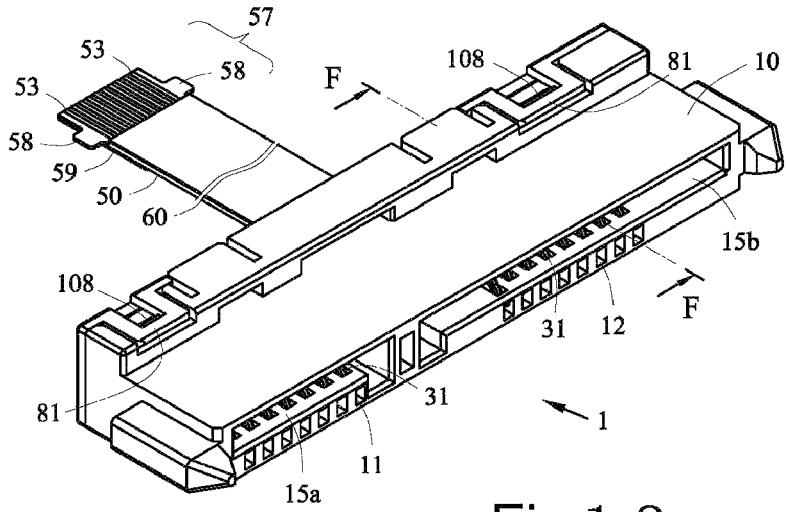
Figure 1:
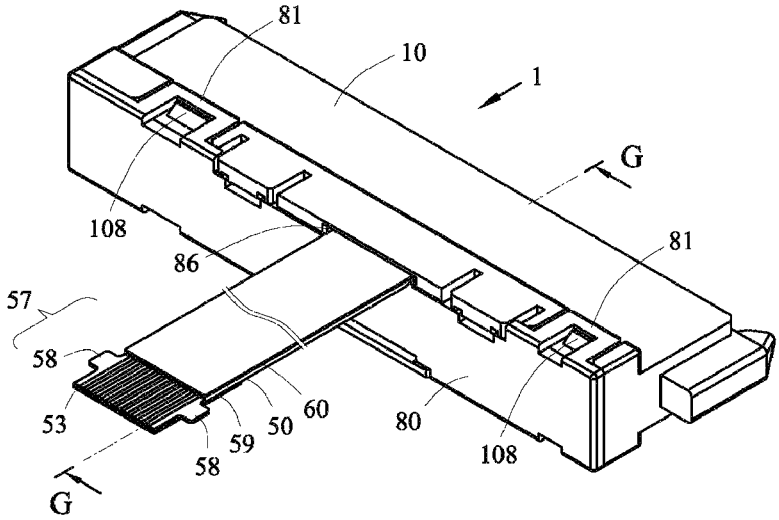
Figure 2:
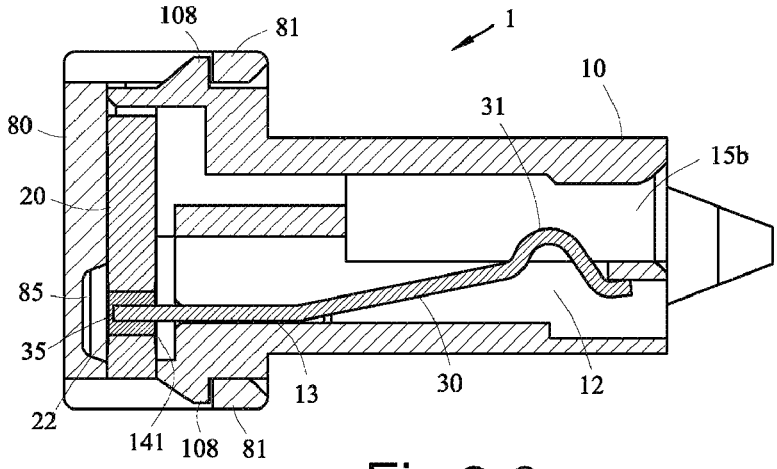
Figure 2:
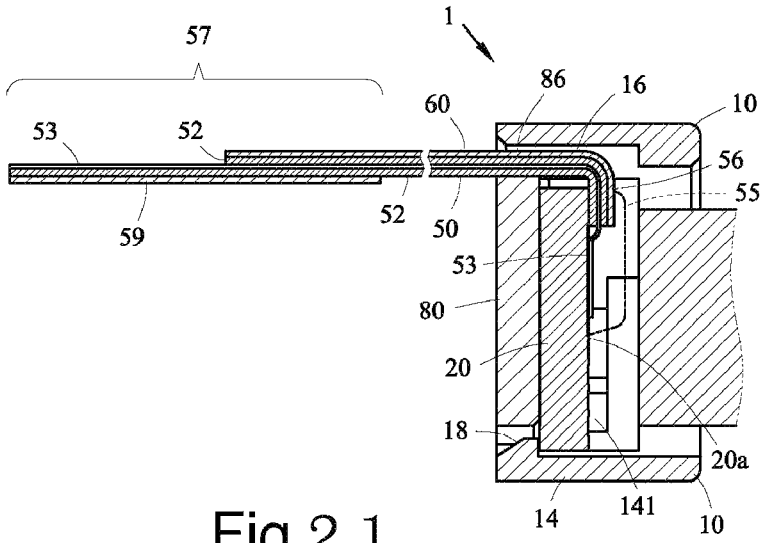
Figure 2:
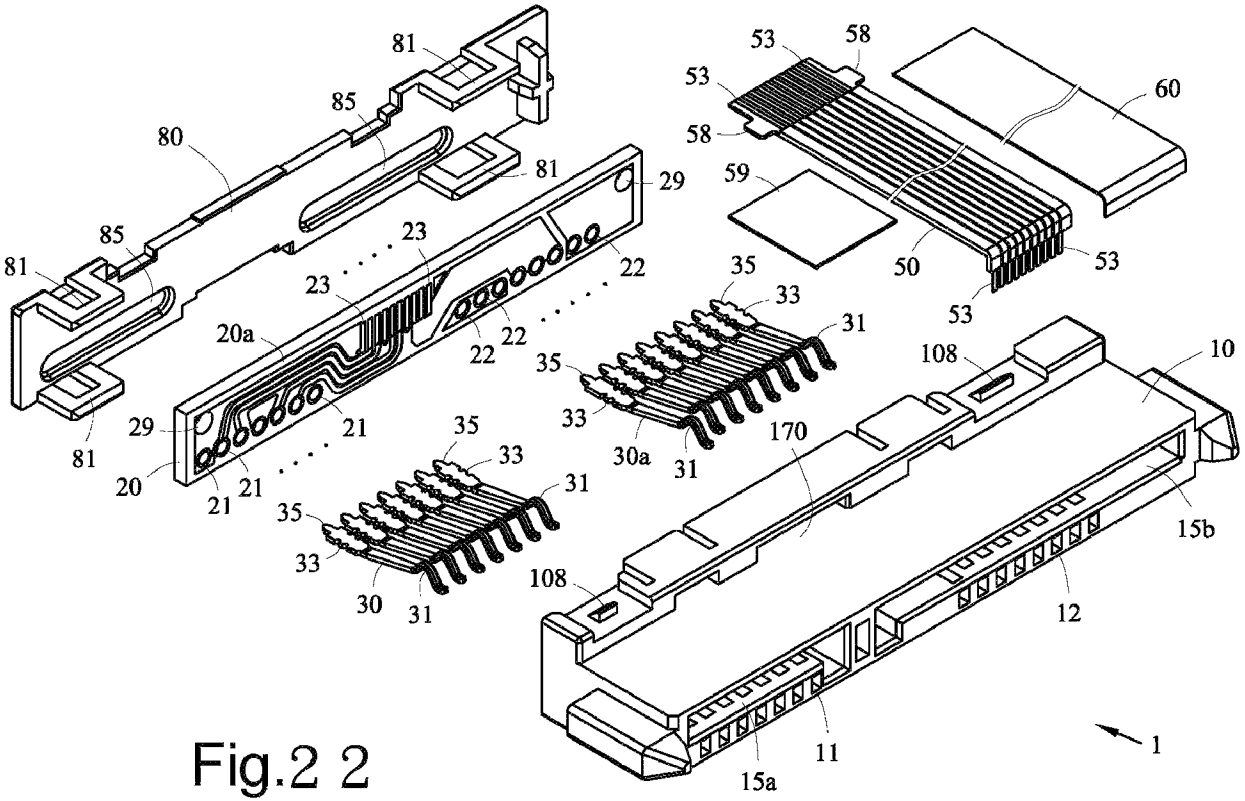
Figure 2:
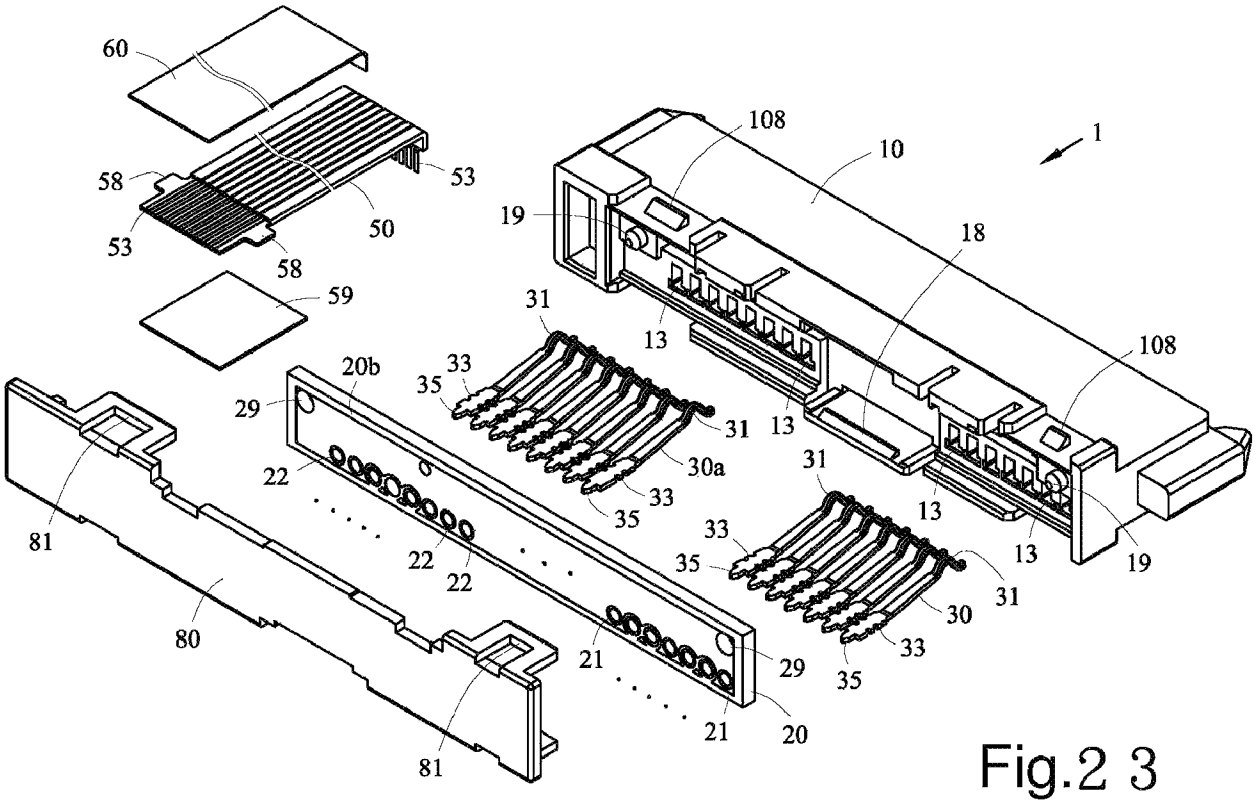
Figure 2:
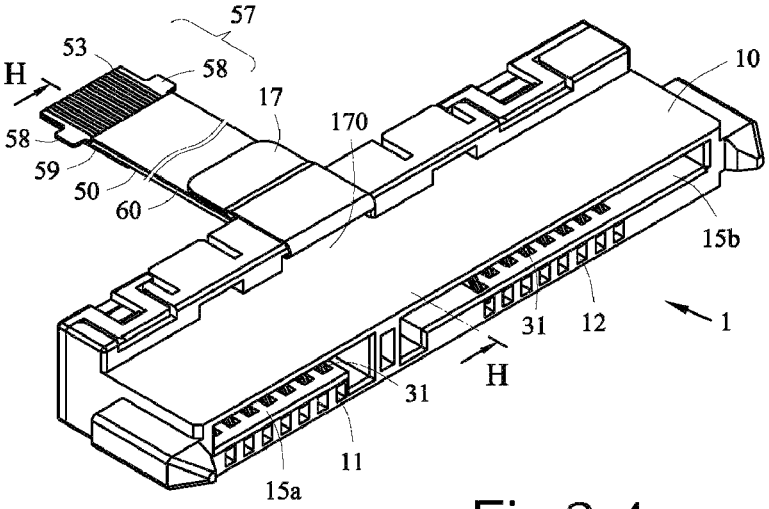
Figure 2:
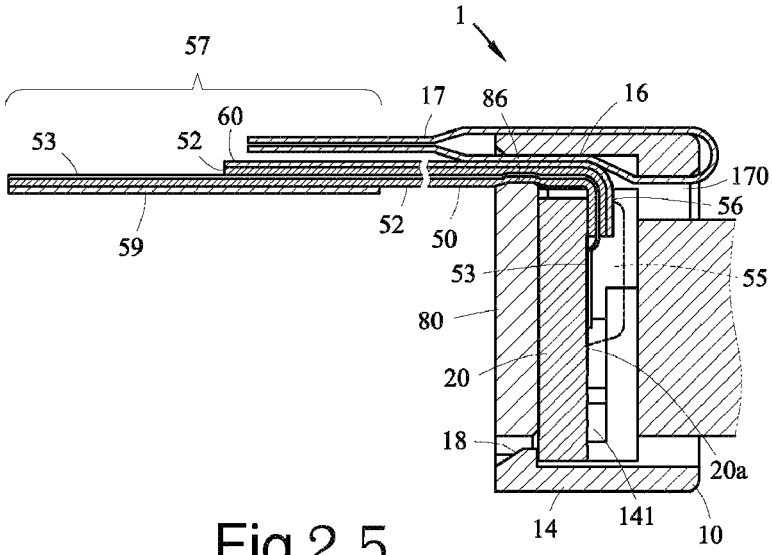
Figure 2:
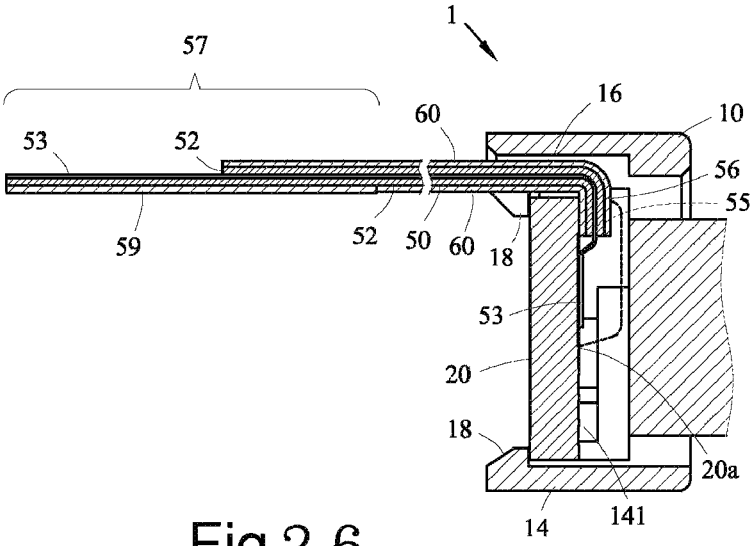
Figure 2:
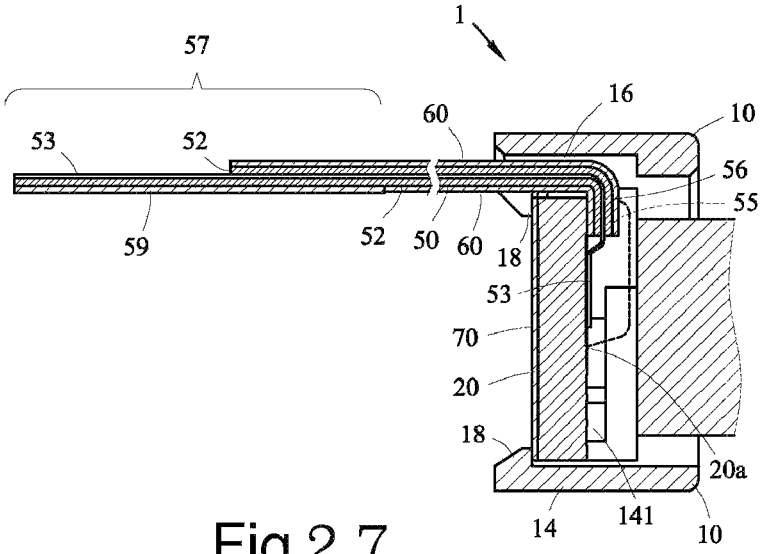
Figure 2:
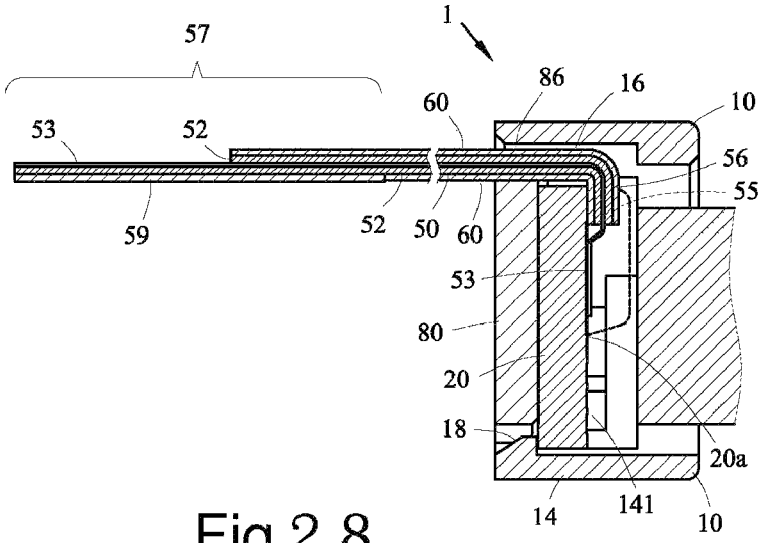

Please refer to FIGS. 7 to 9, in a second embodiment according to the present invention, a pair of lugs 58 is formed at the rear-end 57 of the flexible cable 50, and the rear-end 57 of the flexible cable 50 is adhered to a supporting plate 59; wherein the rear-end 57 of the flexible cable 50 is electrically connected to an FFC connector 90 or an FPC connector (not shown), and the rear-end 57 of the flexible cable 50 is fixed to the FFC connector 90 or the FPC connector using two lugs 58 and the supporting plate 59. Besides, the insulative body 10 is further disposed with a pull-string 17; wherein the pull-string 17 is inserted into a rectangular hole 170 of the insulative body 10 and through the wire slot 16 to be exposed.

Please refer to FIGS. 10 to 11, in a third embodiment according to the present invention, the conductive parts 23 are disposed at the interior side surface 20*a* of the PCB 20, and the exterior side surface 20*b* of the PCB 20 comprises a grounding member 24, and the welding parts 211, 214 and 217 of the first welding parts 21 and the conductive parts 231, 234 and 237 of the plurality of conductive parts 23 are electrically connected to the grounding member 24, the welding parts 212, 213, 215 and 216 of the first welding parts 21 are electrically connected to the conductive parts 232, 233, 235 and 236 of the conductive parts 23; wherein the welding parts 221, 222, 223, 227 and 228 of the second welding parts 22 are electrically connected to the grounding member 24 jointly, and the welding parts 224, 225 and 226 of the second welding parts 22 are electrically connected to the conductive parts 238, 239 and 230 of the plurality of conductive parts 23 jointly. Alternatively, each of the first welding parts 21 and the second welding parts 22 is electrically respectively connected to the conductive parts 23.

Please refer to FIGS. 12 to 17, a connector assembly 1 in a forth embodiment according to the present invention is largely the same to that in the preferred embodiment, except for an insulative film 70 which is further adhered to the exterior side surface 20*b* of the PCB 20; wherein the insulative film 70 is an insulative sticker, an insulative label or an insulative fabric. Besides, the insulative film 70 is further applied to the exterior side surface 20*b* of the PCB and the rear-end 14 of the insulative body 10.

Please refer to FIGS. 18 to 23, a connector assembly 1 in a fifth embodiment according to the present invention is largely the same to that in the preferred embodiment, except for a cover 80 which is engaged to the rear-end 14 of the insulative body 10; wherein the cover 80 is engaged to at least a pair of hooks of the insulative body 10 using at least a pair of fixing parts 81, and a gap 86 is defined by the cover 80 and the insulative body 10, whereby the flexible cable 50 and the protective film 60 are extended outwardly. Besides, when the rear-ends 35 of the first terminals 30 and the second terminals 30*a* are extended beyond the exterior side surface 20*b* of the PCB 20, the cover 80 comprises a pair of grooves 85 to accommodate the extended rear-ends 35 of the first terminals 30 and the second terminals 30*a*. Additionally, when the welding materials of the first wielding parts 21 and the second welding parts 22 are extended beyond the exterior side surface 20*b* of the PCB 20, the two grooves 85 are suitable to accommodate the extended welding materials of the first welding parts 21 and second welding parts 22.

Please refer to FIGS. 24 to 25, a connector assembly 1 in a sixth embodiment according to the present invention is generally the same to that in the fifth embodiment, except for that an the gap 86 forms interfering adaption for the protective film 60 and the flexible cable 50. Besides, the insulative body 10 is further disposed with a pull-string 17; wherein the pull-string 17 passes through the rectangular hole 170 of the insulative body 10, and the pull-string 17 passes through the wire slot 16 and is exposed.

Please refer to FIG. 26, a connector assembly 1 in a seventh embodiment according to the present invention is generally the same to that in the preferred embodiment, except for that a protective film 60 is adhered to both the top face and the bottom face of the flexible cable 50, and a bending member 56 is formed by the two protective films 60 and the front-end of the flexible cable 50, using the wire slot 16, the bending member 56 extends into the interior side surface 20*a* of the PCB 20, the two protective films 60 provide the bending member 56 with proper protection to avoid damage to the bending member 56 while it is bent, in the meanwhile, the two protective films 60 provide the flexible cable 50 with proper protection to prevent the flexible cable 50 from abrasive wear between the flexible cable 50 and the PCB 20. Besides, when the conductors 53 of the flexible cable 50 is transmitting signals, proper shielding is provided by the two protective film 60 to eliminate the crosstalk among the conductors 53 and to reduce the electrical interferences from the surrounding.

Please refer to FIG. 27, a connector assembly 1 in an eighth embodiment according to the present invention is generally the same to that in the fourth embodiment, except for that a protective film 60 is adhered to the top face and bottom face of the flexible cable 50, and a bending member 56 is formed by the two protective films 60 and the front-end of the flexible cable 50, using the wire slot 16, the bending member 56 extends into the interior side surface 20*a* of the PCB 20.

Please refer to FIG. 28, a connector assembly 1 in a ninth embodiment according to the present invention is generally the same to that in the fifth embodiment, except for that a protective film 60 is adhered to the top face and bottom face of the flexible cable 50, and a bending member 56 is formed by the two protective films 60 and the front-end of the flexible cable 50, using the wire slot 16, the bending member 56 extends into the interior side surface 20*a* of the PCB 20; wherein a gap 86 is defined by the cover 80 and the insulative body 10, whereby the flexible cable 50 and the protective film 60 are extended outwardly.

All in all, this application is proposed as the aspects of the present invention are indeed attained, therefore, please grant the patent at an early date so that the purpose of the Patent Law, which is to encourage creativity, could be served. It should be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A flexible cable connector assembly comprising:

an insulative body having a plurality of first terminal slots and a plurality of slots;

a printed circuit board (PCB) having a plurality of first welding parts and a plurality of conductive parts, the PCB being fixed upright into an accommodation space at the rear-end of the insulative body;

a plurality of first terminals inserting into the slots of the insulative body, and the first terminals having rear-ends are welded to the first welding parts of the PCB;

a flexible cable having an insulative layer, covering a plurality of conductors, and the conductors of the flexible cable are electrically connected to the conductive parts of the PCB; and a protective film adhered to the insulative layer of the flexible cable; wherein the insulative body comprises a first inserting space, and the contacting parts of the first terminals are extended into the first inserting space through the first terminal slots, and a wire slot is defined by the insulative body and the PCB, whereby the flexible cable and the protective film are passed outwardly therethrough.

2. The flexible cable connector assembly as claimed in claim 1, wherein the protective film is a conductive shielding film comprising a copper foil or an aluminum foil, and a bending member is formed by the protective film and the front-end of the flexible cable, and the bending member is extended into the interior side surface of the PCB through the wire slot, and a gel is coated onto the bending member and the conductive parts of the PCB.

3. The flexible cable connector assembly as claimed in claim 1, wherein the flexible cable is a flexible flat cable (FFC) or a flexible printed circuit (FPC), a pair of lugs is formed at the rear-end of the flexible cable, and a supporting plate is adhered to the rear-end of the flexible cable.

4. The flexible cable connector assembly as claimed in claim 3, wherein an FFC connector or an FPC connector is electrically connected to the rear-end of the flexible cable, and the rear-end of the flexible cable is fixed to the FFC connector or the FPC connector through the pair of lugs and the supporting plate.

5. The flexible cable connector assembly as claimed in claim 1, wherein the insulative body is disposed with a pull-string, and the pull-string is inserted into a rectangular hole of the insulative body to be exposed through the wire slot.

6. The flexible cable connector assembly as claimed in claim 1, wherein the conductive parts are disposed at the interior side surface of the PCB, and each of the first welding parts are electrically connected to each of the conductive parts respectively.

7. The flexible cable connector assembly as claimed in claim 1, wherein the conductive parts are disposed at the interior side surface of the PCB, a grounding member is disposed at the exterior side surface of the PCB, the welding parts of the first welding parts and the conductive parts of the conductive parts are electrically connected to the grounding member, and the welding parts of the first welding parts are electrically connected to the conductive parts of the conductive parts.

8. A flexible cable connector assembly comprising:

an insulative body having a plurality of first terminal slots, a plurality of second terminal slots and a plurality of slots;

a printed circuit board (PCB) having a plurality of first welding parts, a plurality of second welding parts and a plurality of conductive parts, the PCB being fixed upright into an accommodation space at the rear-end of the insulative body;

a plurality of first terminals inserting into the slots of the insulative body, the first terminals having rear-ends being welded to the first welding parts of the PCB;

a plurality of second terminals inserting into the slots of the insulative body, the second terminals having rear-ends being welded to the second welding parts of the PCB;

a flexible cable having an insulative layer, covering a plurality of conductors, and the conductors of the flexible cable being electrically connected to the conductive parts of the PCB;

a protective film adhered to the insulative layer of the flexible cable; and an insulative film adhered to the exterior side surface of the PCB, wherein the insulative body comprises a first inserting space and a second inserting space, the contacting parts of the first terminals are extended into the first inserting space through the first terminals slots, and the contacting parts of the second terminals are extended into the second inserting space through the second terminals slots, and a wire slot is defined by the insulative body and the PCB, whereby the flexible cable and the protective film are passed outwardly therethrough.

9. The flexible cable connector assembly as claimed in claim 8, wherein the insulative film is selected from the group consisting of an insulative sticker, an insulative label and an insulative fabric, the insulative film is applied to the exterior side surface of the PCB and the rear-end of the insulative body.

10. The flexible cable connector assembly as claimed in claim 8, wherein the protective film is a conductive shielding film containing high conductive materials, and a bending member is formed by the protective film and the front-end of the flexible cable, and the bending member extends into the interior side surface of the PCB through the wire slot, and a gel is coated onto the bending member and the conductive parts of the PCB.

11. The flexible cable connector assembly as claimed in claim 8, wherein the protective film is a conductive shielding film containing a copper foil or an aluminum foil, a bending member is formed by the protective film and the front-end of the flexible cable, the bending member extends into the interior side surface of the PCB through the wire slot, and a gel is coated onto the bending member and the conductive parts of the PCB.

12. The flexible cable connector assembly as claimed in claim 8, wherein the conductive parts are disposed at the interior side surface of the PCB, and each of the first welding parts and the second welding parts is electrically connected to the conductive parts respectively.

13. The flexible cable connector assembly as claimed in claim 8, wherein the conductive parts are disposed at the interior side surface of the PCB, a grounding member is disposed at the exterior side surface of the PCB, the welding parts of the first welding parts and the conductive parts of the conductive parts are electrically connected to the grounding member, and the welding parts of the first welding parts are electrically connected to the conductive parts of the conductive parts.

14. The flexible cable connector assembly as claimed in claim 13, wherein the conductive parts are disposed at the interior side surface of the PCB, a grounding member is disposed at the exterior side surface of the PCB, the welding parts of the second welding parts are electrically connected to the grounding member jointly, and the welding parts of the second welding parts are electrically connected to the conductive parts of the conductive parts jointly.

15. The flexible cable connector assembly as claimed in claim 8, wherein the flexible cable is a flexible flat cable (FFC) or a flexible printed circuit (FPC), a pair of lugs is formed at the rear-end of the flexible cable, and a supporting plate is adhered to the rear-end of the flexible cable.

16. The flexible cable connector assembly as claimed in claim 15, wherein an FFC connector or an FPC connector is electrically connected to the rear-end of the flexible cable, and the rear-end of the flexible cable is fixed to the FFC connector or the FPC connector through the pair of lugs and the supporting plate.

17. The flexible cable connector assembly as claimed in claim 8, wherein the insulative body is disposed with a pull-string, the pull-string is inserted into a rectangular hole of the insulative body and through the wire slot to be exposed.

18. A flexible cable connector assembly comprising:

an insulative body having a plurality of first terminal slots, a plurality of second terminal slots and a plurality of slots;

a PCB having a plurality of first welding parts, a plurality of second welding parts and a plurality of conductive parts, the PCB being fixed upright into an accommodation space at the rear-end of the insulative body;

a plurality of first terminals inserting into the slots of the insulative body, the first terminals having rear-ends being welded to the first welding parts of the PCB;

a plurality of second terminals inserting into the slots of the insulative body, the second terminals having rear-ends being welded to the second welding parts of the PCB;

a flexible cable having an insulative layer, covering a plurality of conductors, and the conductors of the flexible cable being electrically connected to the conductive parts of the PCB;

a protective film adhered to the insulative layer of the flexible cable; and a cover clapping onto the rear-end of the insulative body; wherein the insulative body comprises a first inserting space and a second inserting space, the contacting parts of the first terminals are extended into the first inserting space through the first terminals slots, and the contacting parts of the second terminals are extended into the second inserting space through the second terminals slots, and a wire slot is defined by the insulative body and the PCB, whereby the flexible cable and the protective film are passed outwardly therethrough.

19. The flexible cable connector assembly as claimed in claim 18, wherein the cover is engaged to a pair of fixing parts of the insulative body by a pair of hooks, a gap is defined by the cover and the insulative body and through which the flexible cable and the protective film are extended outwardly.

20. The flexible cable connector assembly as claimed in claim 18, wherein a gap is defined by the cover and the insulative body, whereby the flexible cable and the protective film are extended outwardly, and the gap forms interfering adaption for the protective film and the flexible cable.

21. The flexible cable connector assembly as claimed in claim 18, wherein the protective film is a conductive shielding film containing high conductive materials, a bending member is formed by the protective film and the front-end of the flexible cable, the bending member extends into the interior side surface of the PCB through the wire slot, and a gel is coated onto the bending member and the conductive parts of the PCB.

22. The flexible cable connector assembly as claimed in claim 18, wherein the protective film is a conductive shielding film containing a copper foil or an aluminum foil, a bending member is formed by the protective film and the front-end of the flexible cable, the bending member extends into the interior side surface of the PCB through the wire slot, and a gel is coated onto the bending member and the conductive parts of the PCB.

23. The flexible cable connector assembly as claimed in claim 18, wherein the insulative body comprises a pair of hooks and a pair of positioning rods, and the insulative body engages the PCB by the pair of hooks, and the PCB is fixed to the positioning rods by a pair of fixing holes.

24. The flexible cable connector assembly as claimed in claim 18, wherein the conductive parts are disposed at the interior side surface of the PCB, and each of the first welding parts and the second welding parts are electrically connected to each of the conductive parts.

25. The flexible cable connector assembly as claimed in claim 18, wherein the conductive parts are disposed at the interior side surface of the PCB, a grounding member is disposed at the exterior side surface of the PCB, the welding parts of the plurality of first welding parts and the conductive parts of the plurality of conductive parts are electrically connected to the grounding member, and the welding parts of the plurality of first welding parts are electrically connected to the conductive parts of the plurality of conductive parts.

26. The flexible cable connector assembly as claimed in claim 25, wherein the conductive parts are disposed at the interior side surface of the PCB, a grounding member is disposed at the exterior side surface of the PCB, the welding parts of the second welding parts are electrically connected to the grounding member jointly, and the welding parts of the second welding parts are electrically connected to the conductive parts of the conductive parts jointly.

27. The flexible cable connector assembly as claimed in claim 18, wherein the flexible cable is a flexible flat cable (FFC) or a flexible printed circuit (FPC), a pair of lugs is formed at the rear-end of the flexible cable, and a supporting plate is adhered to the rear-end of the flexible cable.

28. The flexible cable connector assembly as claimed in claim 27, wherein an FFC connector or an FPC connector is electrically connected to the rear-end of the flexible cable, and the rear-end of the flexible cable is fixed to the FFC connector or the FPC connector through the pair of lugs and the supporting plate.

29. The flexible cable connector assembly as claimed in claim 18, wherein the insulative body is disposed with a pull-string, and the pull-string is inserted into a rectangular hole of the insulative body and through the wire slot to be exposed.

30. The flexible cable connector assembly as claimed in claim 18, wherein the cover comprises a pair of grooves to accommodate the rear-ends of the first terminals and the second terminals, or to accommodate the welding material of the first welding parts and the second welding parts.

31. A flexible cable connector assembly comprising:

an insulative body having a plurality of first terminal slots, a plurality of second terminal slots and a plurality of slots;

a PCB having a plurality of first welding parts, a plurality of second welding parts and a plurality of conductive parts, the PCB being fixed upright into an accommodation space at the rear-end of the insulative body;

a plurality of first terminals inserting into the slots of the insulative body, the first terminals having rear-ends being welded to the first welding parts of the PCB;

a plurality of second terminals inserting into the slots of the insulative body, the second terminals having rear-ends being welded to the second welding parts of the PCB;

a flexible cable having an insulative layer, covering a plurality of conductors, and the conductors of the flexible cable being electrically connected to the conductive parts of the PCB;

a protective film adhered to the insulative layer of the flexible cable; wherein the insulative body comprises a first inserting space and a second inserting space, the contacting parts of the first terminals are extended into the first inserting space through the first terminals slots, and the contacting parts of the second terminals are extended into the second inserting space via the second terminals slots, and a wire slot is defined by the insulative body and the PCB, whereby the flexible cable and the protective film are passed outwardly therethrough.

32. The flexible cable connector assembly as claimed in claim 31, wherein an insulative film is adhered to the exterior side surface of the PCB, and the insulative film is selected from the group consisting of an insulative sticker, an insulative label and an insulative fabric.

33. The flexible cable connector assembly as claimed in claim 31, wherein a cover is engaged to the rear-end of the insulative body, and a gap is defined by the cover and the insulative body, whereby the flexible cable and the protective film are extended outwardly.

* * * * *